US005611860A

United States Patent [19]

Waech

[11] Patent Number: 5,611,860

[45] Date of Patent: Mar. 18, 1997

[54] HYDROSTATIC SHEAR INDUCING SHORT DWELL COATER

[75] Inventor: Theodore G. Waech, Janesville, Wis.

[73] Assignee: Beloit Technologies, Inc., Wilmington, Del.

[21] Appl. No.: 443,126

[22] Filed: May 17, 1995

[51] Int. Cl.[6] ..... B05C 5/00

[52] U.S. Cl. ..... 118/410; 118/413; 118/419

[58] Field of Search ..... 118/410, 413, 118/419; 427/356

[56] References Cited

U.S. PATENT DOCUMENTS

| | | | |
|---|---|---|---|
| 4,357,370 | 11/1982 | Alheid | 427/211 |
| 4,688,516 | 8/1987 | Sommer | 118/413 |
| 4,702,196 | 10/1987 | Kratzberger . | |
| 4,761,309 | 8/1988 | Embry | 427/294 |
| 4,834,018 | 5/1989 | Sollinger et al. . | |
| 4,839,201 | 6/1989 | Rantanen et al. | 427/355 |
| 4,860,686 | 8/1989 | Kato et al. | 118/410 |
| 4,880,671 | 11/1989 | Sollinger et al. . | |
| 4,961,968 | 10/1990 | Shands et al. | 427/356 |
| 5,133,996 | 7/1992 | Busker . | |
| 5,173,120 | 12/1992 | Suzumura et al. | 118/419 |
| 5,183,691 | 2/1993 | Hassell et al. | 427/286 |
| 5,192,591 | 3/1993 | Chance | 427/356 |
| 5,199,991 | 4/1993 | Chance | 118/410 |

OTHER PUBLICATIONS

Andy Harrison, "New Coating Technologies Combine High Speeds with Higher Quality", pp. 60–64, Pulp & Paper May 1994.

*Primary Examiner*—Laura Edwards

*Attorney, Agent, or Firm*—Dirk J. Veneman; Raymond W. Campbell; Gerald A. Mathews

[57] ABSTRACT

A coater head has a housing which defines a coating pond supplied with coating under pressure. A plurality of bars extend within the coating pond in the cross-machine direction, and are spaced parallel to one another in the machine direction. A paper web is engaged against a backing roll, and travels through the coating pond past a metering blade which applies coating from the pond to the web. The bars induce a turbulent flow which shears bubbles of air entrained in the coating pond, thereby reducing the bubble diameters and air-induced imperfections in the coating. Greater machine speed, which tends to entrain more air, induces greater shear at the bars which causes bubble size to be more greatly reduced.

2 Claims, 3 Drawing Sheets

78
24
36
20
22

HYDROSTATIC SHEAR INDUCING SHORT DWELL COATER

FIELD OF THE INVENTION

The present invention relates to apparatus for coating a web of paper in general and to short dwell coater apparatus in particular.

BACKGROUND OF THE INVENTION

Paper of specialized performance characteristics may be created by applying a thin layer of coating material to one or both sides of the paper. The coating is typically a mixture of a fine plate-like mineral, typically clay or particulate calcium carbonate; coloring agents, typically titanium dioxide for a white sheet; and a binder which may be of the organic type or of a synthetic composition. Coated paper is typically used in magazines, commercial catalogs and advertising inserts in newspapers. The coated paper may be formed with a smooth bright surface which improves the readability of the text and the quality of photographic reproductions. Coated papers are divided into a number of grades. The higher value grades, the so-called coated free-sheet, are formed of paper fibers wherein the lignin have been removed by digestion. Less expensive grades of coated paper contain ten percent or more ground-wood pulp which is less expensive than pulp formed by digestion.

Coated ground-wood papers include the popular designation "lightweight coated" (LWC) paper. For lightweight coated paper, coating weight is approximately thirty percent of total sheet weight and these grades of paper are popular with magazine publishers, direct marketers, and commercial printers as the lighter weight paper saves money on postage and other weight-related costs. With the increasing demand for lighter weight, lower cost coated papers, there is an increasing need for more efficiency in the production of these paper grades.

Paper is typically more productively produced by increasing the speed of formation of the paper and coating costs are kept down by coating the paper while still on the paper-making machine. Because the paper is made at higher and higher speeds and because of the advantages of on-machine coating, the coaters in turn must run at higher speeds. The need in producing lightweight coatings to hold down the weight of the paper and the costs of the coating material encourages the use of short dwell coaters which subject the paper web to the coating material for a short period of time and thus limit the depth of penetration of the coating and hence the coating weight.

High speed coater machines are key to producing lightweight coated papers cost-effectively. However, the use of short dwell coaters at high machine speeds has led to defects in the coating, typically coating streaks. Coating streaks are caused by air entrained in the boundary layer of the raw stock or paper web. The boundary layer air forms bubbles in the coating pond, and the bubbles pressing up against a metering blade prevent the coating from uniformly flowing under the blade.

What is needed is a means for preventing the formation of large bubbles in the coating pond adjacent to the metering blade.

SUMMARY OF THE INVENTION

The short dwell coater of this invention employs a plurality of spaced apart rods or bars which extend across the coater in the cross-machine direction. The bars are submersed in the coating pond within the coater head. The paper web is engaged against a backing roll, and travels through the coating pond at the end of which is positioned a metering blade which applies the coating to the web. The bars are spaced one thousandth to 250 thousandths of an inch from the paper being coated. The bars induce a turbulent flow which shears bubbles of air entrained in the coating pond, thereby reducing the bubble diameters to perhaps about eight-thousandths of an inch with no larger bubbles left over. The turbulence-generating bars may be rectangular in cross-section and may be mounted on upstanding flanges which extend from the coater head base to support the bars closely spaced from the backing roll. The metering blade is positioned downstream of the bars. Coating is fed into the pond near the metering blade. The coating flows under the bars. From the bars part of the flow goes over the lip forming the upstream edge of the coating pond, while the remainder of the coating is drawn back toward the metering blade over the metering blade. Entrained bubbles are reduced in size as the coating flows past the bars and onto the metering blade for application to the web.

It is a feature of the present invention to provide a short dwell coater which may be run at higher speeds.

It is another feature of the present invention to provide a short dwell coater for use in on-machine coating.

It is also a feature of the present invention to provide a short dwell coater which prevents the formation of streaks at high coating velocities.

It is a further feature of the present invention to provide a short dwell coater which uniformly wets a coating base.

Further objects, features and advantages of the invention will be apparent from the following detailed description when taken in conjunction with the accompanying drawings.

DESCRIPTION OF THE PREFERRED EMBODIMENT

Figure 1:
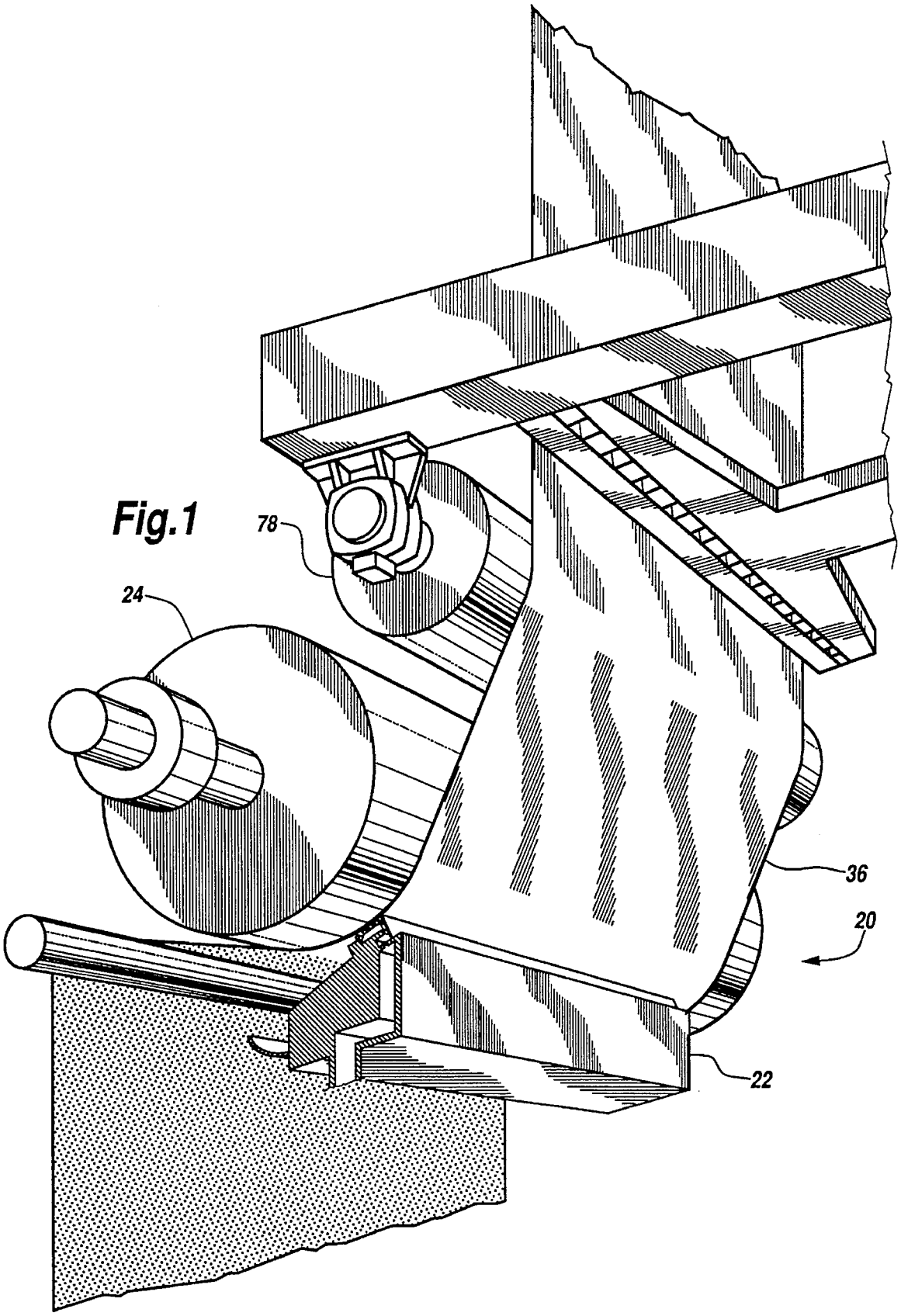
FIG. 1 is a side-elevational, isometric view, partly cut away, of the short dwell coater of this invention.
Figure 2:
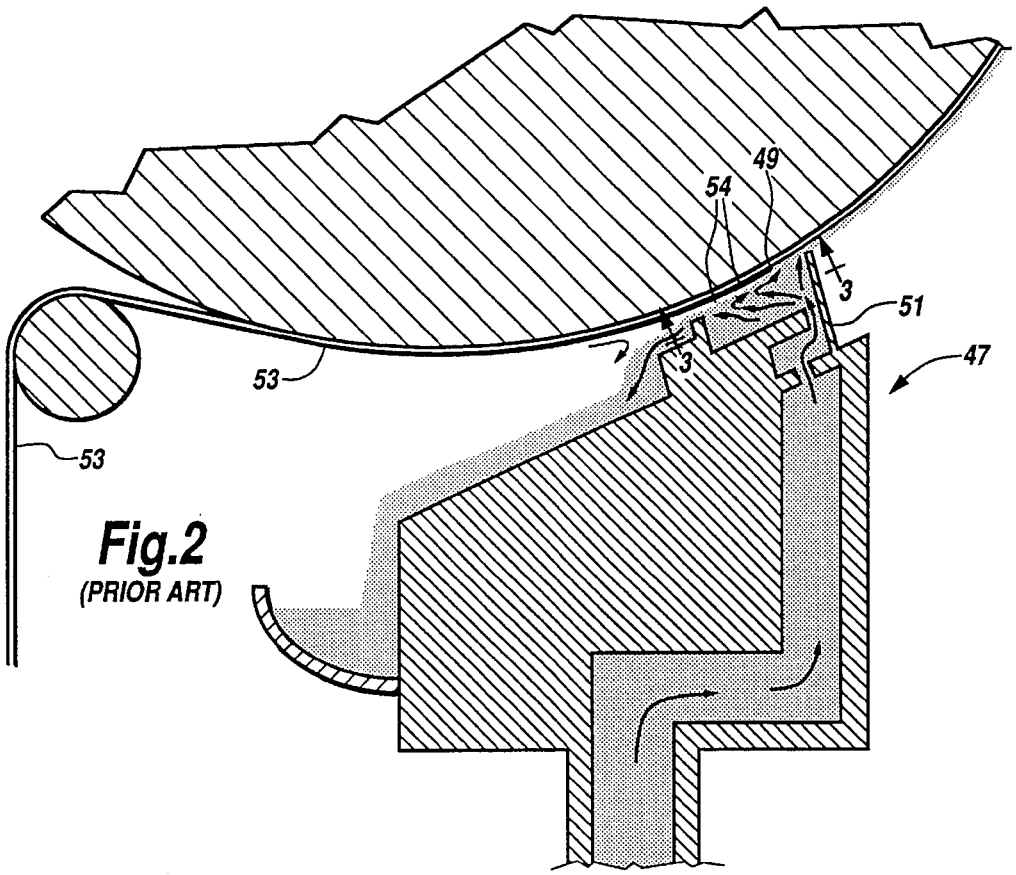
Fig.2 (PRIOR ART)
FIG. 2 is a side-elevational, cross-sectional view of a prior art short dwell coater.
Figure 3:
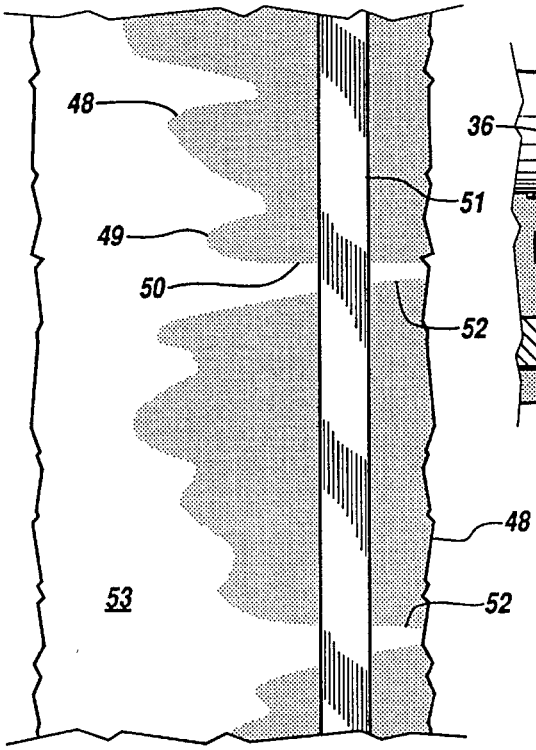
Fig.3 (PRIOR ART)
FIG. 3 is a bottom plan view of a paper web passing through the prior art coater of FIG. 2 taken along section line 3—3.
Figure 5:
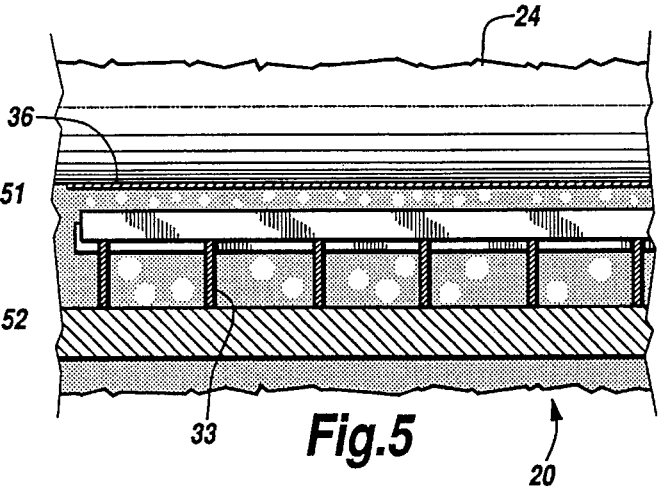
FIG. 5 is a cross-sectional view of the short dwell coater of FIG. 4 taken along section line 5—5.
Figure 4:
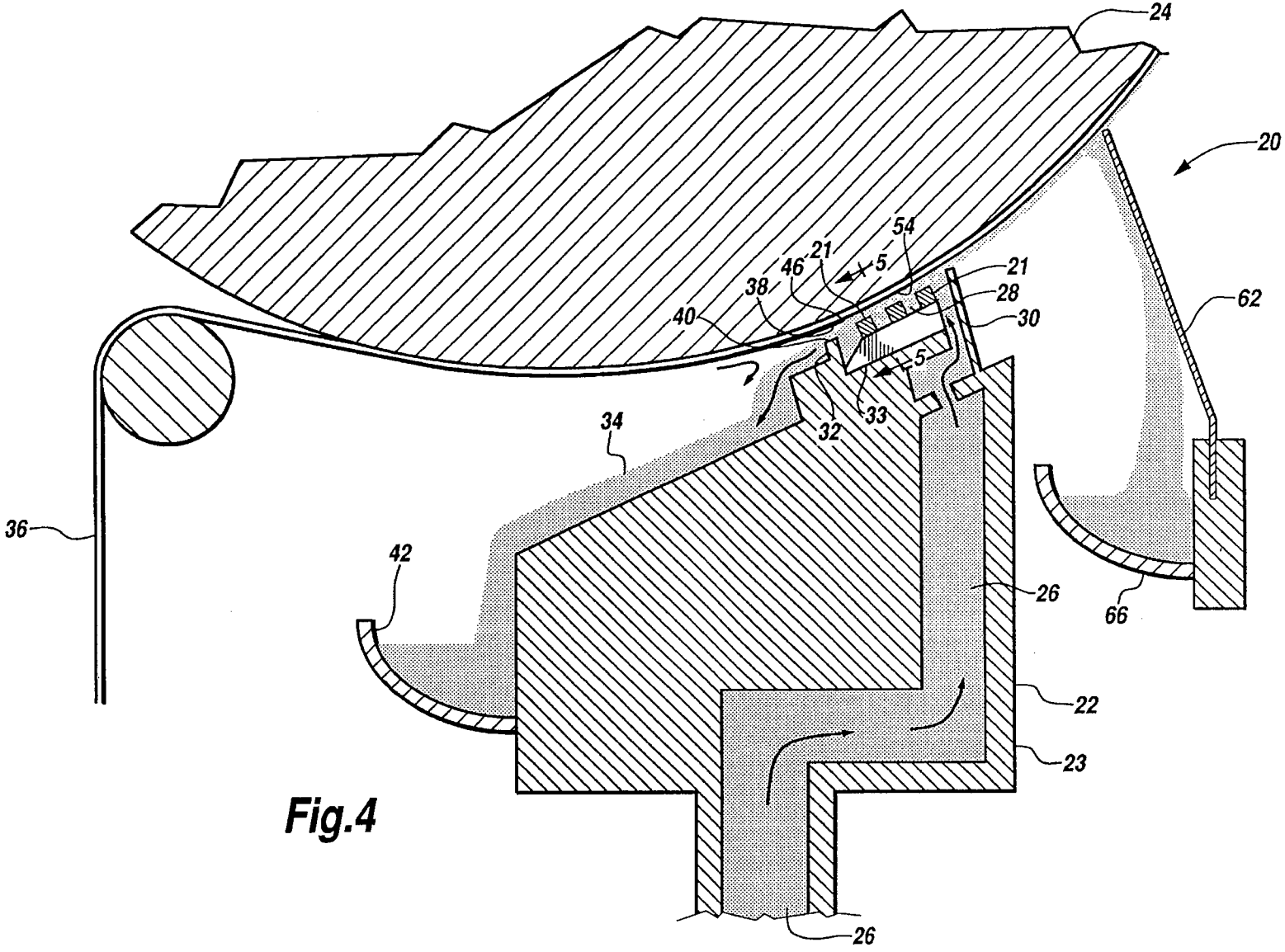
FIG. 4 is a cross-sectional, elevational view of the short dwell coater of FIG. 1.

Referring more particularly to FIGS. 1–5 wherein like numbers refer to similar parts, an improved short dwell coater 20 is shown in FIGS. 1, 4, and 5. The coater 20 has a coater head 22 which is disposed below a backing roll 24 such that a paper web 36 to be coated is engaged by the backing roll as it passes through the coater head 22. The coater head 22 has a housing 23 which defines a pond 28 which extends at least the width of the web 36 and which receives coating to be applied to the web.

A plurality of parallel turbulence generating bars 21 are mounted to the coating head 22 housing 23 and extend in a cross-machine direction within the pond 28. The pond 28 is formed between a premetering blade 30 and a baffle plate 32. Coating 34 is supplied from a pressurized coating source to the pond from an inlet 26 formed in the housing beneath the pond, and counterflows from the premetering blade 30 to the baffle plate 32 in the up-machine direction.

The paper web 36 moves through the pond in a direction opposite to the flow of the coating 34. The coating 34 overflows the baffle plate 32 over a lip 40 and is collected in a trough 42 for reuse. As the web 36 moves through the pond, the coating 34 contacts the paper along a constantly moving and fluctuating dynamic contact line 46. The bars 21 are mounted on narrow flanges 33 which support the bars in closely spaced relation to the moving web 36.

In prior art coaters, such as the coater 47 shown in FIG. 2, the dynamic contact line 49 is in constant motion with respect to the premetering blade 51 and beyond a certain web speed fingers of air 50, as shown in FIG. 3, will on occasion pass under the premetering blade 51 to cause streaks 52 on the coated paper 48. Air is induced into the pond by a boundary layer of air which is dragged through the gap between the lip and the backing roll along with the fast moving paper web. As shown in FIG. 2, the wetted surface of the web 53 drags a boundary layer of coating 34 along with the web setting up a high velocity flow indicated by arrows 54 toward the premetering blade 51.

The bars 21 positioned in the pond of the coater head 22 of the coater 20 of this invention, as shown in FIG. 4, project into the fluid flow along the web and create fluid dynamic shear between the bars 21 and the web 36. Shear in the coating 34 between the bars 21 and the web 36 means that the velocity of the coating changes rapidly between the velocity of the coating which is attached to the web, which may be moving at a hundred feet per second, and the velocity of the coating which is in the boundary layer in the bars 21 which is stationary.

Because the bars 21 are spaced between a few thousandth and a quarter of an inch away from the web, it may be seen that the hydrodynamic shear rate may vary between a few feet/min per thousandth of an inch to a few hundreds of feet/min per thousandth of an inch. These extremely high hydrodynamic shears when interacting with air bubbles which are moving along in proximity to the web cause the bubbles to be torn apart. The size of a bubble being formed is of course dependent on the hydrodynamic shear. In general, the bubbles will be reduced in size until the surface tension which holds the bubble together is able to overcome the shearing action of the fluid. In an experiment where water was run through a shear generator, one inch diameter bubbles were reduced in size to an average size below 0.2 millimeters in diameter. Greater machine speed, which tends to entrain more air, induces greater shear at the bars which causes bubble size to be more greatly reduced.

The structure of a bubble is defined by the surface tension which holds the bubble together. Surface tension is a two-dimensional force, thus as the bubble size decreases, the surface tension forces fall off as the second power of bubble size. However this force becomes much stronger relative to the volume of the bubble which falls off as the third power. Thus, extremely small bubbles can withstand a greater hydrodynamic shear.

Extremely small bubbles do not present the same problem as large bubbles, and are less likely to form streaks on the finished coated paper. The small bubbles may be smaller than the thickness of the coating in which case they may have little impact on the surface properties of the coated paper. Further, to the extent the bubbles create voids, they merely create some additional porosity in the coating over that induced by the drying process.

Extremely small bubbles have high surface energy relative to the volume and can create extremely high pressures within the bubbles which can force the gases into solution with the coating.

Another factor in the formation of small bubbles is that certain chemicals, such as detergents, when mixed in water generally lead to smaller bubbles than those found in pure water. This is probably because the chemicals reduce the surface tension energy and so the bubbles must be smaller to withstand the hydrodynamic shears produced. Such chemicals are in most cases already present in the coating formulation to aid in the dispersion of the solids suspended in the liquid. However, if desirable, additional chemicals for reducing the surface tension could be added to the coating. The problem of streaking becomes more severe as the velocity of the papermaking machine and the web 36 increase. On the other hand, the hydrodynamic shear caused by the turbulence generating bars 21 is directly proportional to the speed. Thus, as the problem of streaking increases with increasing machine speed, the solution presented by the bars 21 also increases.

As shown in FIG. 4, a final metering blade 62 is positioned downstream and down-machine from the coating head 22. The final metering blade scrapes as much as ninety percent or more of the coating which has been applied to the paper, and forms the final even layer which is dried on the web 36. The coating removed by the final metering blade 62 is collected in a trough 66 for reuse. The coated web 36 then leaves the backing roll 24 and passes over a turning roll 78 and enters a dryer section (not shown).

It should be understood, however, that the premetering blade 30 could be replaced by a final metering blade. It should also be understood that wherein the turbulence generating bars are shown supported by flanges 33 which are spaced apart to allow the flow of coating under the bars, other means for supporting the bars could be used including wire rods, or extending the bars 21 down to the coater head 22, and drilling holes through the bars for the passage of the coating.

It should also be understood that the number of bars used may be varied and that one, two, three, or more bars may be effective. It should also be understood that although the gap between the bars and the paper web may vary between one-thousandth of an inch and about a quarter of an inch, the gap will depend on the speed of the web being coated, the viscosity and composition of the coating, and the thickness of the coating which it is desired to apply to the web.

It should also be understood that although the coating is shown entering adjacent to the premetering blade and counterflowing beneath the turbulence-generating bars, the flow could be brought in near the baffle plate lip or between the baffle plate lip and the premetering blade. Thus, in general it should be understood that the turbulence generating bars can be used in any short dwell coater having a pond through which a paper web is drawn.

Referring to FIG. 4, it should be noted that in an alternative embodiment coater, a plurality of bars which are spaced from each other in the machine direction may be formed with a solid underlying support to prevent flow through the bars. Such an arrangement would still be expected to produce advantageous results in reducing bubble size.

It should be understood that the last bar in the machine direction could be tapered towards the backing roll to reduce the likelihood of a buildup of a bubble downstream of the shear generating bars. In addition other means known to those skilled in the art could be used to prevent the formation of a vortex after the bars.

It should be understood that although a paper web is described, the coating could be done on a roll surface which is later transferred to a paper web, such as in a size press.

It is understood that the invention is not limited to the particular construction and arrangement of parts herein illustrated and described, but embraces such modified forms thereof as come within the scope of the following claims.

I claim:

1. A coater apparatus for applying coating material to a web guided by a backing roll, said apparatus comprising:

a coater head housing disposed in close proximity to the backing roll such that the web guided by the backing roll moves between the backing roll and the head housing, wherein the housing defines an application chamber which opens toward the web and which extends along the web in a cross-machine direction, and wherein the application chamber receives and retains coating material in a coating pond, and wherein the application chamber is connected to a pressurized source of coating material;

portions of the coater head housing which define a baffle plate upstream of the application chamber, wherein the baffle plate has portions defining a lip spaced from the backing roll, and wherein excess coating material within the application chamber overflows the baffle plate lip to escape the application chamber;

a premetering blade mounted to the coater housing downstream of the application chamber which engages the web against the backing roll, wherein coating is applied by the premetering blade to the web;

a first bar member fixed within the head housing and spaced upstream from the premetering blade, wherein the first bar member extends in the cross-machine direction across the housing; and a second bar member fixed within the head housing and spaced upstream from the first member, wherein the second bar member is substantially parallel to the first bar member, the bar members being positioned within the head housing such that coating flows downstream both beneath and above the members, and wherein both bar members are spaced between one thousandth of an inch and about two-hundred-and-fifty thousandths of an inch from the web.

2. The short dwell coater of claim 1 wherein the members are rectangular in cross section.

* * * * *